US012146289B1

(12) United States Patent
Deters

(10) Patent No.: US 12,146,289 B1
(45) Date of Patent: Nov. 19, 2024

(54) SELF ADJUSTING TWIN STAGE LOCKING COUPLER

(71) Applicant: Luke John Deters, Spring Grove, MN (US)

(72) Inventor: Luke John Deters, Spring Grove, MN (US)

( * ) Notice: Subject to any disclaimer, the term of this patent is extended or adjusted under 35 U.S.C. 154(b) by 686 days.

(21) Appl. No.: 17/508,336

(22) Filed: Oct. 22, 2021

Related U.S. Application Data

(60) Provisional application No. 63/104,682, filed on Oct. 23, 2020.

(51) Int. Cl.
*E02F 3/36* (2006.01)

(52) U.S. Cl.
CPC ..... *E02F 3/3686* (2013.01); *E02F 3/3663* (2013.01)

(58) Field of Classification Search
None
See application file for complete search history.

(56) References Cited

U.S. PATENT DOCUMENTS 3,794,195 A * 2/1974 Clevenger ..... E02F 3/3631 414/723
4,846,624 A * 7/1989 Hohn ..... E02F 3/3622 172/275
5,098,252 A * 3/1992 Sheesley ..... E02F 3/3686 403/324
5,107,610 A * 4/1992 Fusco ..... E02F 3/3627 37/444
6,499,934 B1 * 12/2002 Kaczmarski ..... E02F 3/3668 37/468
7,779,562 B1 * 8/2010 Loveless ..... E02F 3/3686 37/231
8,528,239 B2 * 9/2013 Andrina ..... E02F 3/966 37/468
9,809,945 B1 * 11/2017 Middleton ..... E02F 3/964
11,486,112 B2 * 11/2022 Bell ..... E02F 3/3627
2002/0127090 A1 * 9/2002 Dick ..... E02F 3/3627 414/723

* cited by examiner

*Primary Examiner* — Jamie L McGowan
*Assistant Examiner* — Audrey L Lusk
(74) *Attorney, Agent, or Firm* — JOHNSON AND PHUNG; Thomas N. Phung

(57) ABSTRACT

A front-end loader adapter plate self-adjusting twin stage locking coupler having an extendable and retractable adapter plate lock pin having an elongated body with a first end, a second tapering locking slot engaging end, an exterior surface having a pair of opposing rails, and an extendable and retractable adapter plate lock foot having a lock foot body with the lock foot body including a first end, a second tapering female coupling structure engaging end, and an interior channel having a pair of opposing rail slots matingly engaging the corresponding rails of the lock pin therein to slidably support and maintain at least a portion of the lock pin within the interior channel of the lock foot.

20 Claims, 4 Drawing Sheets

SELF ADJUSTING TWIN STAGE LOCKING COUPLER

FIELD OF THE INVENTION

This invention relates generally to front-end loaders that uses an adaptor plate to mount various attachment tools to the loader and, more specifically to an attachment device that assist in securing the attachment tool to the adaptor plate of the loader to reduce or eliminate misalignment or play between the attachment point between the attachment tool and the adaptor plate to improve use while reducing defects and wear.

CROSS REFERENCE TO RELATED APPLICATIONS

This application claims priority to currently pending U.S. Provisional Application Ser. No. 63/104,682; filed on Oct. 23, 2020; titled SELF ADJUSTING TWIN STAGE LOCKING COUPLER.

STATEMENT REGARDING FEDERALLY SPONSORED RESEARCH OR DEVELOPMENT

None

REFERENCE TO A MICROFICHE APPENDIX

None

BACKGROUND OF THE INVENTION

Front-end loaders, such as skid-steer loaders, have at their front end, a lifting and tilting means such as a pair of hydraulically operated load-lifting arms attached to a male coupling structure such as an adapter plate at the ends of the arms distal the loaders and a pair of hydraulically operated load-tilting pistons attached proximal the loader.

Each attachment device that may be used with the loader generally includes a female coupling structure directly secured to attachment devices. The male coupling structure/adaptor plate is adapted to be selectively coupled to and uncoupled from the female coupling structure. When the male coupling structure/adaptor plate is coupled to the female coupling structure, the attachment device may be selectively lifted and lowered, by means of the load-lifting arms of the associated front-end loaders, and may be selectively tilted, by means of the load-tilting pistons in order to perform various tasks.

In order to assist in the releasably securement of the male coupling structure/adaptor plate to the female coupling structure, it is well known in the art to use actuated pins, wedges, or similar components to releasably secure the male coupling structure/adapter plate to the female coupling structure.

All female quick couplers are manufactured within certain tolerance guidelines. All female couplers have some degree of misalignment or play when coupled to the male coupling structure/adapter plate. All female couplers that are not new can have the previous defects and wear.

The misalignment or play in the coupling between the female coupling structure and the male coupling structure/adapter plate may be due to but not limited to variance in manufacturing process of the female coupling structure, female coupling structure manufactured and sold by difference sources and previous defects and wear to the female coupling structure and/or the male coupling structure/adapter plate.

Any amount of play in the couplings between the female coupling structure and the male coupling structure/adapter plate creates stress in risers in the male and female couplings. The machine may direct all of its load to a very small area of the coupler causing failures to the structure which may leads to premature wear on mating surfaces and locks of male and female coupling, wear on pins and bushings in the loader boom and tilt cylinders through vibration, and even uncoupling of attachment from machine.

FIG. 1 is a side view showing the mating between a male coupling structure or adaptor plate 10 to a female coupling structure 11 of an attachment tool. Releasably securing the adapter plate 10 to the female coupling structure 11 is an actuated locking pin 12, which extends from the adaptor plate 10 and engages a locking slot 21 located on the female coupling structure 11 assist in maintaining the connection between the adapter plate 10 to the female coupling structure 11.

As shown in FIG. 1, the coupling between the female coupling structure 11 and the adapter plate 10 results in the presence of a clearance or slop spacing 13 from fitment issues such as due to misalignment resulting in vertical and horizontal play between the adaptor plate 10 and the female coupling structure 11.

The present invention addresses the above problem by providing for a self-adjusting twin stage locking coupler that eliminates fitment issues between the female coupling structure and the male coupling structure/adapter plate thereby greatly reducing or eliminating the amount of play with its self-adjusting abilities to provided full contact with the mating and locking surfaces between the female coupling structure and the male coupling structure/adapter plate to achieve longer life of work tool attachments, machine and machine coupler(s).

SUMMARY OF THE INVENTION

Briefly, the present invention comprises a skid steer loader adapter plate locking system that includes a skid steer loader adapter plate having at least one attachment tool female coupling structure locking point. Located at the attachment tool female coupling structure locking point is a hydraulically powered self-adjusting twin stage locking coupler releasably securing the adapter plate to a female coupling structure of a front-end loader attachment tool.

The self-adjusting twin stage locking coupler including an extendable and retractable adapter plate lock pin having an elongated body with the body including a first end, a second tapering locking slot engaging end, an exterior surface having a pair of opposing rails. The self-adjusting twin stage locking coupler also including an extendable and retractable adapter plate lock foot having a lock foot body with the lock foot body including a first end, a second tapering female coupling structure engaging end, and an interior channel having a pair of opposing rail slots matingly engaging the corresponding rails of the lock pin therein to slidably support and maintain at least a portion of the lock pin within the interior channel of the lock foot.

Extending in a perpendicular direction from the elongated body of the adapter plate lock pin proximal the first end of the elongated body adapter plate lock pin is a stop member. Located within the interior channel of the adapter plate lock foot is a lock foot ledge that is engageable with the stop member of the adapter plate lock pin to limit the movement of the stop member within the interior channel of the adapter plate lock foot to maintain the support of the adapter plate lock pin by the adapter plate lock foot.

The self-adjusting twin stage locking coupler may also include a cylindrical channel slide having an adapter plate lock foot interior supporting surface for slidably supporting the adapter plate lock foot therein and a lock foot adapter plate attached to a top end of the cylindrical channel slide.

DESCRIPTION OF THE PREFERRED EMBODIMENT

Figure 1:
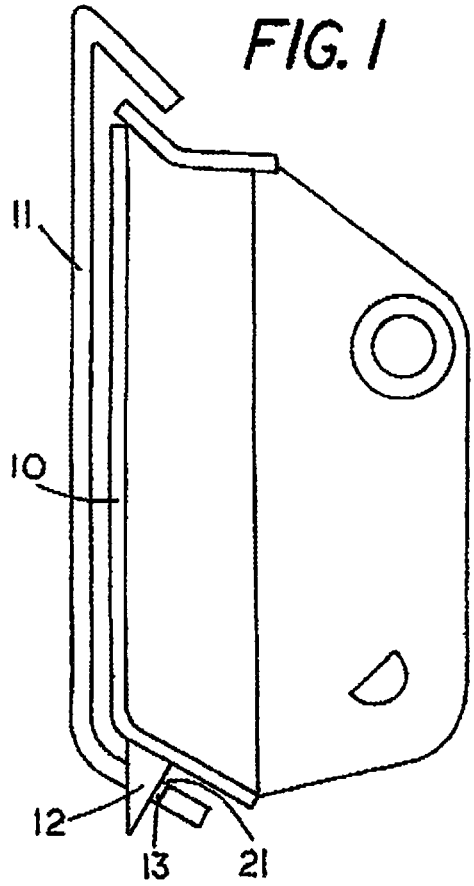
FIG. 1 is a side view showing the mating between a male coupling structure or adaptor plate to a female coupling structure of an attachment tool.

The general purpose of the present invention, which will be described subsequently in greater detail, is to provide an attachment device that assist in securing the attachment tool to the adaptor plate of the loader to reduce or eliminate misalignment or play between the attachment point between the attachment tool and the adaptor plate to improve use while reducing defects and wear.

There has thus been outlined the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the disclosing subject matter be regarded as including such equivalent constructions insofar as they do not depart from the spirit and scope of the present invention.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

In addition, the accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of any potential claims.

Figure 2:
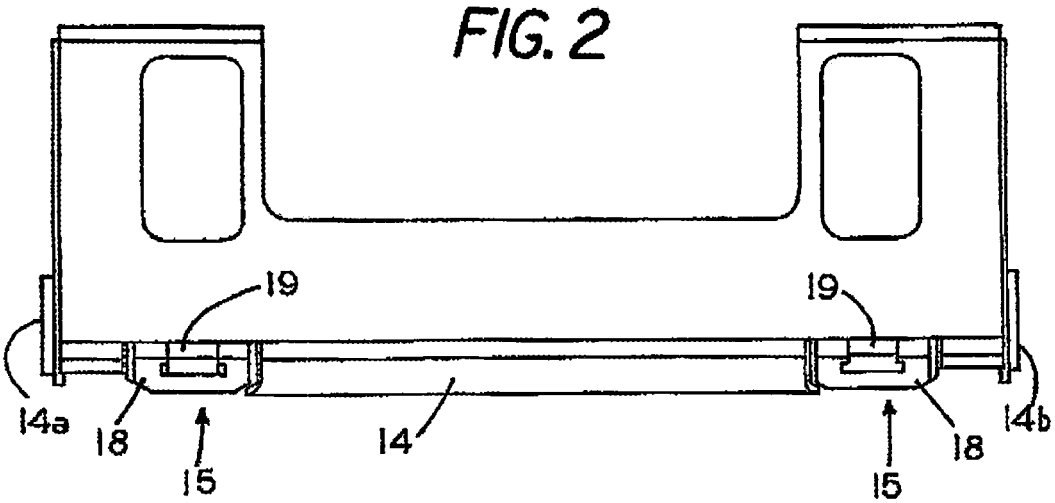
FIG. 2 is a front view showing an embodiment of an adapter plate having supporting a self-adjusting locking coupler proximal each of the sides of the adapter plate.

Referring to the drawings, FIG. 2 is a front view showing an embodiment of a male coupling structure or adapter plate 14 that may be used for example with a skid steer loader with loader lift arms having a front-end frame assembly. The adaptor plate 14 includes a first side 14*a* and a second side 14*b* and supporting a self-adjusting locking coupler 15 of the present invention proximal each of the sides of the adapter plate 14.

Figure 3:
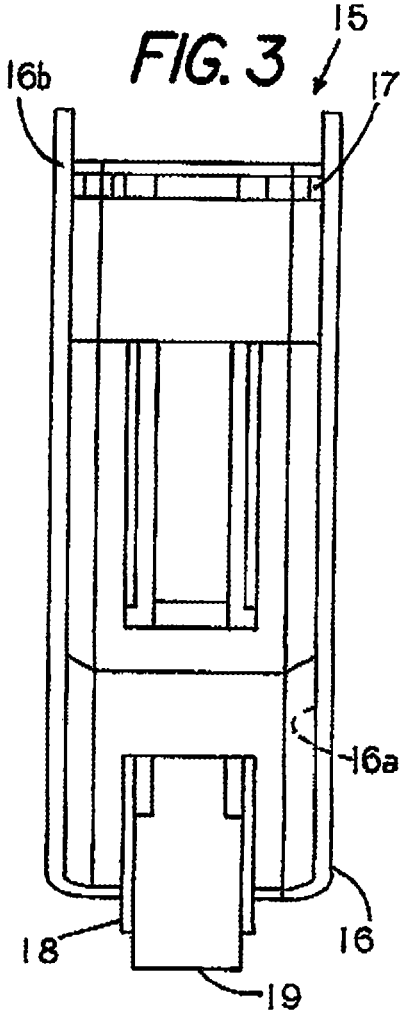
FIG. 3 is a close-up view of the self-adjusting twin stage locking coupler of FIG. 2.
Figure 4:
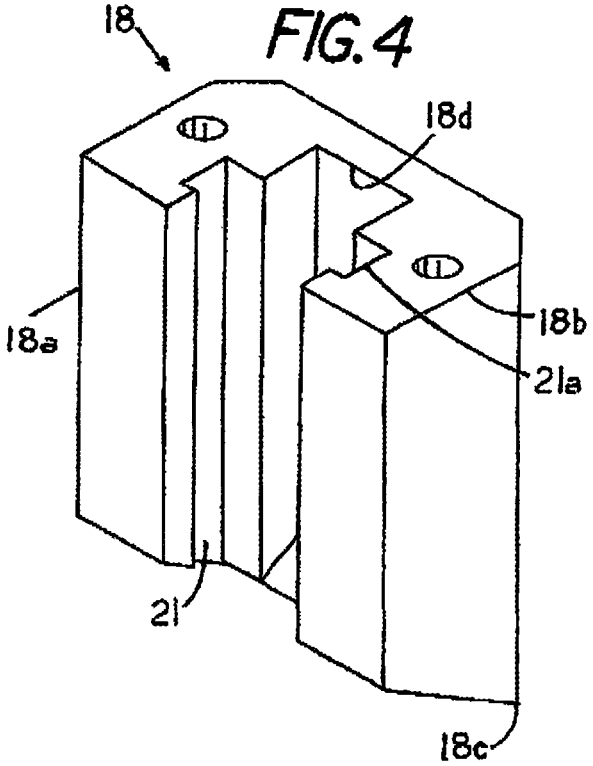
FIG. 4 is a close-up perspective view showing a lock foot of the self-adjusting twin stage locking coupler of FIG. 3.

FIG. 3 is a close-up view of the self-adjusting twin stage locking coupler 15 shown in FIG. 2, which is generally made up of a cylindrical channel slide 16, a lock foot adapter plate 17, a foot lock 18 and a lock pin 19. FIG. 4 is a close-up perspective view showing a lock foot 18 of the self-adjusting twin stage locking coupler 15 of FIG. 3, which generally includes a lock foot body 18*a* having a first end 18*b*, a second tapering female coupling structure engaging end 18*c*, and an interior surface or interior channel 18*d* that includes a pair of opposing rail slots 21 and 21*a*.

Figure 5:
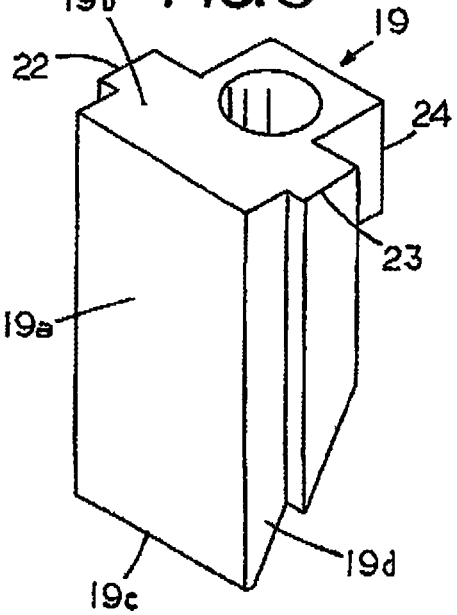
FIG. 5 is a close-up perspective view showing a lock pin of the self-adjusting twin stage locking coupler of FIG. 3.
Figure 6:
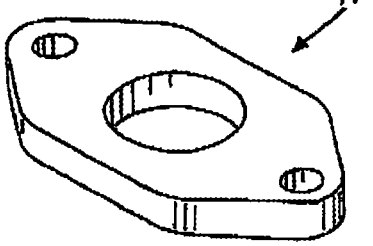
FIG. 6 is a close-up perspective view showing a lock foot adapter plate of the self-adjusting twin stage locking coupler of FIG. 3.
Figure 7:
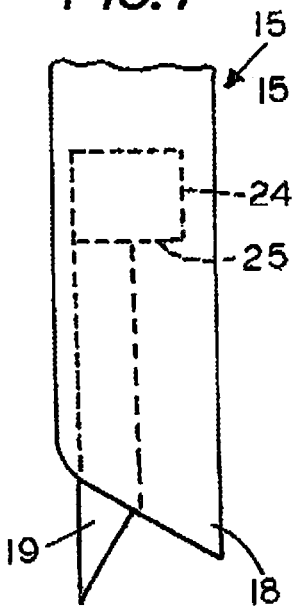
FIG. 7 is a partial view showing the engagement between the lock foot and the lock pin of FIGS. 4 and 5.

FIG. 5 is a close-up perspective view showing the lock pin 19 of the self-adjusting twin stage locking coupler 15 of FIG. 3, which includes an elongated body 19*a* having a first end 19*b*, a second tapering locking slot engaging end 19*c*, and an exterior surface 19*d* having a pair of opposing rectangular-shaped rails 22 and 23 extending therefrom. FIG. 6 is a close-up perspective view showing a lock foot adapter plate 17 of the self-adjusting twin stage locking coupler 15 of FIG. 3. FIG. 7 is a partial view showing the engagement between the lock foot 18 and the lock pin 19.

Figure 8:
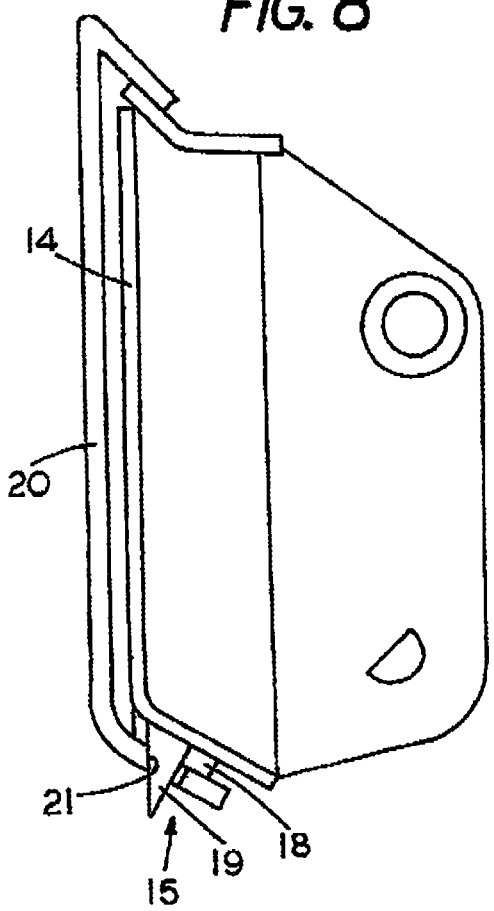
FIG. 8 is a side view showing the self-adjusting twin stage locking coupler of FIG. 3 releasably securing an adapter plate to a female coupling structure.

FIG. 8 is a side view showing the mating between adapter plate 14 and a female coupling structure 20 of an attachment tool with the self-adjusting twin stage locking coupler 15 releasably securing the adapter plate 14 to the female coupling structure 20.

The self-adjusting locking couplers 15 shown in the embodiment of FIG. 2 are generally located at the locking points of the traditional locking mechanism, such as actuated pins and wedges, between the adaptor plate 14 to the female coupling structure 20 of the attachment tool. As shown FIG. 3, the lock foot adapter plate 17 is attached to a top end 16*b* of the cylindrical channel slide 16, which includes an interior surface 16*a* for supporting the lock foot 18 of FIG. 4 therein. The lock foot 18 is shown in FIG. 4 having interior surface or interior channel 18*d* that conforms with a portion of an exterior surface 19*d* of the lock pin 19, and more specifically, with the opposing rail slots 21 and 21*a* of lock foot 18 supporting the corresponding rectangular-shaped rails 22 and 23 of the lock pin 19 therein to slidably support and maintain at least a portion of the lock pin 19 within the interior channel 18*d* of the lock foot 18.

The embodiment of FIGS. 5 and 7 also shows the lock pin 19 having a stop member 24 extending in a perpendicular direction from the elongated body 19*a* proximal the first end 19*b* of the elongated body 19*b*. The stop member 24 of the lock pin 19 is engageable with a lock foot ledge 25 located within the interior channel 18*d* of the lock foot 18 to limit the movement of the stop member 24 of the lock pin 19 within the interior channel 18*d* of the lock foot 18 so as to maintain the support of the lock pin 19 by the lock foot 18.

Figure 9:
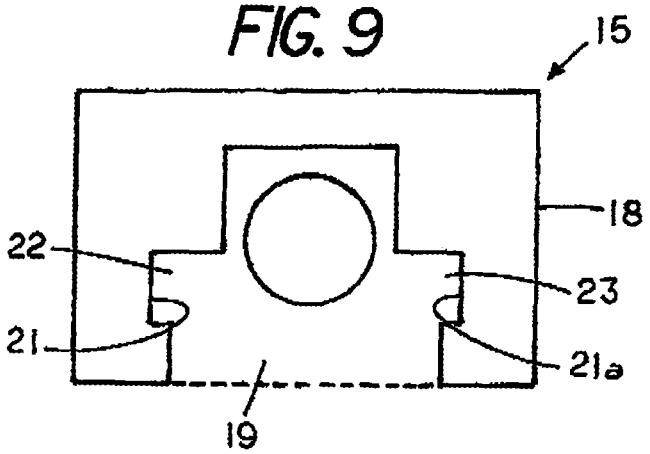
FIG. 9 is a cross-section view of FIG. 7 showing the engagement between the lock foot and the lock pin.

FIG. 9 is a cross-section view showing the engagement between the lock foot 18 and the lock pin 19.

Figure 10:
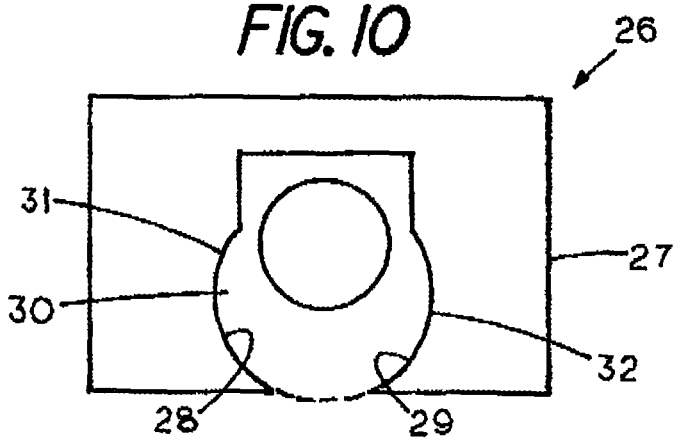
FIG. 10 is a cross-section view showing a lock foot having arc-shaped opposing rail slots supporting corresponding curve-shaped rails of a lock pin.

FIG. 10 is a cross-section view showing an alternative embodiment of a self-adjusting locking coupler 26 having a lock foot 27 having an interior channel with arc-shaped opposing rail slots 28 and 29 supporting corresponding curve-shaped rails 31 and 32 of a lock pin 30 therein to slidably support and maintain at least a portion of the lock pin 30 within an interior channel of the lock foot 30.

Figure 11:
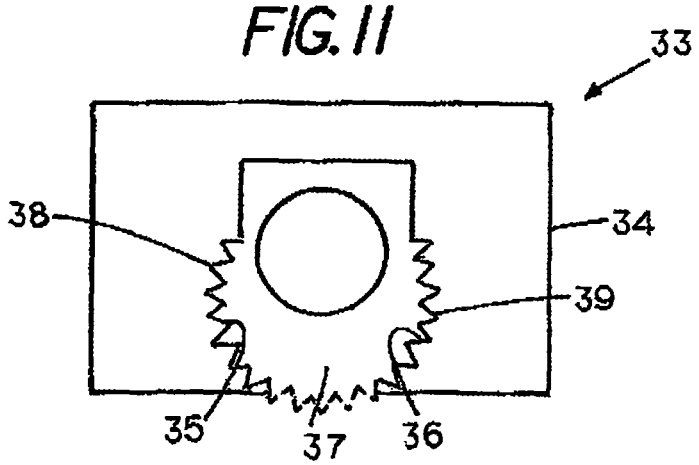
FIG. 11 is a cross-section view showing a lock foot having spline-shaped opposing rail slots supporting corresponding spline-shaped rails of a lock pin.

FIG. 11 is a cross-section view showing an alternative embodiment of a self-adjusting locking coupler 33 having a lock foot 34 having an interior channel with spline-shaped opposing rail slots 35 and 36 supporting corresponding spline-shaped rails 38 and 39 of a lock pin 37 therein to slidably support and maintain at least a portion of the lock pin 37 within an interior channel of the lock foot 34.

Referring to FIG. 8, the self-adjusting twin stage locking coupler 15 functions to reduce or eliminate the clearance or slop spacing resulting from fitment issues between the female coupling structure 20 and the adapter plate 14 by not only providing for the engagement of the female coupling structure engaging end 18*c* to a portion of the female coupling structure 20 such as the region of the female coupling structure 20 that surrounds the locking slot 21 but also incorporating the extension of the lock pin 19 into the locking slot 21. The aforementioned results the displacement of the female coupling structure 20 with respect to the adapter plate 14 so as to fill in or eliminate the vertical clearance or vertical slop spacing located between the female coupling structure 20 and the adapter plate 14 thereby greatly reducing or eliminating the potential for vertical and horizontal play between the adaptor plate 14 and the female coupling structure 20 to achieve improve stability and longer life of work tool attachment. This is due to the stress point, which typically is concentrated at the connection point between adaptor plate 10 and the female coupling structure 11 as shown in FIG. 1, is distributed to more than one engagement points between the adaptor plate 14 and the female coupling structure 20, such as for example a first connection point or region located proximal a bottom end of both the adaptor plate 14 and the female coupling structure 20 and second connection point or region located proximal a top end of both the adaptor plate 14 and the female coupling structure 20 as shown in FIG. 8.

Any amount of play in the couplings between the female coupling structure and the male coupling structure/adapter plate creates stress in risers in the male and female couplings. The machine may direct all of its load to a very small area of the coupler causing failures to the structure which may leads to premature wear on mating surfaces and locks of male and female coupling, wear on pins and bushings in the loader boom and tilt cylinders through vibration, and even uncoupling of attachment from machine.

Process of Locking Coupler

It is noted that the process of using the self-adjusting twin stage locking coupler 15 to lock the adaptor plate 14 to the female coupling structure 20 may involve a mechanical based means or operation, an electrical based means or operation, a hydraulic based means or operation and a pneumatic based means or operation, or their various combination of the aforementioned. An example of the process of locking the adaptor plate 14 to the female coupling structure 20 may include starting with an operator first inserting or mating the adaptor plate 14 to the female coupling structure 20 of the attachment tool while rolling the self-adjusting locking couplers 15 back and up or with the self-adjusting locking couplers 15 in a contracted condition.

An operator then holds down an attachment lock auxiliary hydraulic switch which results in hydraulic fluid from a valve on the loader is controlled by pressure relief valve and flows through pressure lock on a port on a barrel flowing through a gland into a tube dispersing fluid onto a barrel side of a first piston which extends first piston and a rod in a gland and a barrel. The first piston and the rod are connected to the lock pin 19 which extends into the female coupler locking slot 21 and function to secure the adaptor plate 14 to the female coupling structure 20 of the attachment tool.

While fluid is dispersing onto the first piston through a tube, fluid is also rising-up between the tube and a slightly larger hole in the second piston creating an orifice. The aforementioned creates a pressure and flow drop which results in a delayed movement in second piston compared to an assembly of the first piston, rod, and lock pin 19.

The second piston is connected to a second rod which connects to the gland which connects to the adapter which is connected to the lock foot 18. When fluid presses on the barrel side of the second piston the assembly of the second piston, barrel, gland, adapter, and lock foot 18 and extends in the gland, the barrel and machined slide of male coupler weldment. Also, independently of assembly the first piston, rod, and lock pin 19 to adjust to female coupling appropriately. The lock foot 18 extends outward or downward such that the female coupling structure engaging end 18*c* of the lock foot 18 comes into contact with a portion of the female coupling structure 20 such as the region of the female coupling structure 20 that surrounds the locking slot 21. The lock foot 18 then applies further pressure to the female coupling structure 20 to displace the female coupling structure 20 with respect to the adapter plate 14 close out or eliminate the vertical clearance or vertical slop spacing located between the female coupling structure 20 and the adapter plate 14 thereby greatly reducing or eliminating the potential for vertical and horizontal play between the adaptor plate 14 and the female coupling structure 20.

Fluid is continuously being sent back to machine reservoir through a port on barrel while locks find their maximum extension for the given situation.

Process of Unlocking Coupler

In the process of unlocking the adaptor plate 14 from the female coupling structure 20 the operator holds down an attachment unlock auxiliary hydraulic switch which initiates the flow of hydraulic fluid from a valve on the loader into the port on the barrel.

Hydraulic fluid is then pushed on both the first and second pistons and rod side. The first and second pistons push pressurized fluid out of barrel back through the port releasing a pressure lock. Fluid is then sent back to the machine reservoir until maximum retraction of the lock foot and locking pin are met.

The first piston is connected to rod which is connected to the lock pin 19 which is secured in female coupler locking slot 21. This assembly slides back up into the barrel through a slide in the lock foot 18 and the gland while port in the barrel is energized The second piston is connected to the rod which is connected to the gland which is connected to the adapter which is connected to lock foot 18 which is wedged onto a female coupler lower locking flange. The aforementioned assembly slides back in the machined slide of the male coupler weldment, gland and into the barrel while the port is energized.

It is noted that the above step of retraction may proceed in any order. Whichever lock foot 18 or lock pin 19 has less friction holding it in will retract first and is not critical with unlocking.

When the unlocking process is completed the operator may then disengage the adaptor plate 14 from the female coupling structure 20 of the attachment tool by setting the attachment tool on a ground surface and roll the adaptor plate 14 away from the attachment tool and backs loader up.

It is noted that although the embodiments of FIGS. 2-8 show the use of a pair self-adjusting twin stage locking coupler 15 to assist in the securement of the adaptor plate 14 to the female coupling structure 20 to reduce or eliminate the clearance or slop spacing resulting from fitment issues such as due to misalignment resulting in vertical and horizontal play between the adaptor plate 14 to the female coupling structure 20, alternative embodiments of the present invention may provide for the use of as few as a single self-adjusting twin stage locking coupler 15 to a plurality of self-adjusting twin stage locking couplers 15 to assist in the securement of the adaptor plate 14 to the female coupling structure 20.

In addition, although the embodiments of FIGS. 2-8 show the use of a hydraulic fluid-based locking coupler, alterative embodiments of the present invention may also include but is not limited to the use of an electric, mechanical or gas-based locking coupler.

It is also noted that the self-adjusting twin stage locking coupler 15 of the present invention may be used in various equipment, such as those that utilize the standard Bobcat® quick attach system. These categories include small payloaders, wheeled skid steer, tracked skid steer, and tractor loaders. It is further noted that the self-adjusting twin stage locking coupler 15 may be incorporated in some manner in each of the aforementioned equipment to eliminate fitment issues between the female coupling structure 20 and the adapter plate 14 thereby eliminating any amount of play with its self-adjusting abilities to provided full contact with the mating and locking surfaces between the female coupling structure 20 and the adapter plate 14 to extending the use lift of the use life of work tool attachment, machine and machine coupler.

I claim:

1. A self-adjusting twin stage locking coupler for releasably securing an adapter plate to a female coupling structure of a front-end loader attachment tool comprising:

an extendable and retractable adapter plate lock pin having an elongated body with said body including a first end, a second tapering locking slot engaging end, an exterior surface having a pair of opposing rails;

a stop member extending in a perpendicular direction from said elongated body of said adapter plate lock pin proximal said first end of said elongated body adapter plate lock pin;

an extendable and retractable adapter plate lock foot having a lock foot body with said lock foot body including a first end, a second tapering female coupling structure engaging end, and an interior channel having a pair of opposing rail slots matingly engaging said corresponding rails of said lock pin therein to slidably support and maintain at least a portion of said lock pin within said interior channel of said lock foot; and a lock foot ledge located within said interior channel of said adapter plate lock foot, said lock foot ledge engageable with said stop member of said adapter plate lock pin to limit the movement of said stop member within said interior channel of said adapter plate lock foot to maintain the support of the adapter plate lock pin by said adapter plate lock foot.

2. The self-adjusting twin stage locking coupler of claim 1 wherein said pair of opposing rails of said adapter plate lock pin comprises rectangular-shaped opposing rails.

3. The self-adjusting twin stage locking coupler of claim 1 wherein said pair of opposing rails of said adapter plate lock pin comprises curve-shaped opposing rails.

4. The self-adjusting twin stage locking coupler of claim 1 wherein said pair of opposing rails of said adapter plate lock pin comprises spline-shaped opposing rails.

5. The self-adjusting twin stage locking coupler of claim 1 including a cylindrical channel slide having an adapter plate lock foot interior supporting surface for slidably supporting said adapter plate lock foot therein.

6. The self-adjusting twin stage locking coupler of claim 5 including a lock foot adapter plate attached to a top end of said cylindrical channel slide.

7. The self-adjusting twin stage locking coupler of claim 1 including a skid steer loader adapter plate having at least one attachment tool female coupling structure locking point with said extendable and retractable adapter plate lock pin and said extendable and retractable adapter plate lock foot located on said skid steer loader adapter plate at said female coupling structure locking point.

8. The self-adjusting twin stage locking coupler of claim 1 wherein said extendable and retractable adapter plate lock foot is hydraulically powered.

9. A skid steer loader adapter plate locking system comprising:

a skid steer loader adapter plate having at least one attachment tool female coupling structure locking point;

a self-adjusting twin stage locking coupler releasably securing said adapter plate to a female coupling structure of a front-end loader attachment tool, said locking coupler located at said attachment tool female coupling structure locking point, said locking coupler including:

an extendable and retractable adapter plate lock pin having an elongated body with said body including a first end, a second tapering locking slot engaging end, an exterior surface having a pair of opposing rails; and an extendable and retractable adapter plate lock foot having a lock foot body with said lock foot body including a first end, a second tapering female coupling structure engaging end, and an interior channel having a pair of opposing rail slots matingly engaging said corresponding rails of said lock pin therein to slidably support and maintain at least a portion of said lock pin within said interior channel of said lock foot.

10. The skid steer loader adapter plate locking system of claim 9 including a stop member extending in a perpendicular direction from said elongated body of said adapter plate lock pin proximal said first end of said elongated body adapter plate lock pin and a lock foot ledge located within said interior channel of said adapter plate lock foot, said lock foot ledge engageable with said stop member of said adapter plate lock pin to limit the movement of said stop member within said interior channel of said adapter plate lock foot to maintain the support of the adapter plate lock pin by said adapter plate lock foot.

11. The skid steer loader adapter plate locking system of claim 10 including a cylindrical channel slide having an adapter plate lock foot interior supporting surface for slidably supporting said adapter plate lock foot therein.

12. The skid steer loader adapter plate locking system of claim 11 including a lock foot adapter plate attached to a top end of said cylindrical channel slide.

13. The skid steer loader adapter plate locking system of claim 12 wherein said extendable and retractable adapter plate lock foot is hydraulically powered.

14. The skid steer loader adapter plate locking system of claim 13 wherein said at least one attachment tool female coupling structure locking point comprises two female coupling structure locking point located in a spaced condition from each other.

15. The skid steer loader adapter plate locking system of claim 14 wherein said pair of opposing rails of said adapter plate lock pin comprises rectangular-shaped opposing rails.

16. The skid steer loader adapter plate locking system of claim 14 wherein said pair of opposing rails of said adapter plate lock pin comprises curve-shaped opposing rails.

17. The skid steer loader adapter plate locking system of claim 14 wherein said pair of opposing rails of said adapter plate lock pin comprises spline-shaped opposing rails.

18. A skid steer loader adapter plate locking system comprising:

a skid steer loader adapter plate having at least one attachment tool female coupling structure locking point;

a hydraulically powered self-adjusting twin stage locking coupler releasably securing said adapter plate to a female coupling structure of a front-end loader attachment tool, said locking coupler located at said attachment tool female coupling structure locking point, said locking coupler including:

a stop member extending in a perpendicular direction from said elongated body of said adapter plate lock pin proximal said first end of said elongated body adapter plate lock pin;

an extendable and retractable adapter plate lock pin having an elongated body with said body including a first end, a second tapering locking slot engaging end, an exterior surface having a pair of opposing rails;

an extendable and retractable adapter plate lock foot having a lock foot body with said lock foot body including a first end, a second tapering female coupling structure engaging end, and an interior channel having a pair of opposing rail slots matingly engaging said corresponding rails of said lock pin therein to slidably support and maintain at least a portion of said lock pin within said interior channel of said lock foot;

a lock foot ledge located within said interior channel of said adapter plate lock foot, said lock foot ledge engageable with said stop member of said adapter plate lock pin to limit the movement of said stop member within said interior channel of said adapter plate lock foot to maintain the support of the adapter plate lock pin by said adapter plate lock foot;

a cylindrical channel slide having an adapter plate lock foot interior supporting surface for slidably supporting said adapter plate lock foot therein; and a lock foot adapter plate attached to a top end of said cylindrical channel slide.

19. The skid steer loader adapter plate locking system of claim 18 wherein said pair of opposing rails of said adapter plate lock pin comprises rectangular-shaped opposing rails.

20. The skid steer loader adapter plate locking system of claim 18 wherein said pair of opposing rails of said adapter plate lock pin comprises curve-shaped opposing rails.

* * * * *